United States Patent [19]

Milberger

[11] Patent Number: 5,020,593

[45] Date of Patent: Jun. 4, 1991

[54] LATCH RING FOR CONNECTING TUBULAR MEMBERS

[75] Inventor: Lionel J. Milberger, Houston, Tex.

[73] Assignee: Vetcogray Inc., Houston, Tex.

[21] Appl. No.: 516,261

[22] Filed: Apr. 30, 1990

Related U.S. Application Data

[63] Continuation-in-part of Ser. No. 286,603, Dec. 16, 1988, Pat. No. 492,876, and a continuation-in-part of Ser. No. 362,843, Jun. 6, 1989.

[51] Int. Cl.[5] ..... E21B 33/043

[52] U.S. Cl. ..... 166/208; 166/382; 285/141; 285/922

[58] Field of Search ..... 166/208, 214, 237, 382; 285/140, 141, 133.2, DIG. 23

[56] References Cited

U.S. PATENT DOCUMENTS

| | | | |
|---|---|---|---|
| 3,420,308 | 1/1969 | Putch | 166/208 |
| 3,918,747 | 11/1975 | Putch | 166/208 |
| 4,528,738 | 7/1985 | Galle, Jr. | 285/3 |
| 4,550,782 | 11/1985 | Lawson | 166/382 |
| 4,773,477 | 9/1988 | Putch | 166/206 |
| 4,909,546 | 3/1990 | Nobileau | 285/141 |
| 4,919,460 | 4/1990 | Milberger et al. | 166/208 |
| 4,928,769 | 5/1990 | Milberger et al. | 166/382 |

*Primary Examiner*—Ramon S. Britts
*Assistant Examiner*—Terry L. Melius
*Attorney, Agent, or Firm*—James E. Bradley

[57] ABSTRACT

A device for releasably locking an inner member within the bore of a tubular outer member holds load in upward and downward directions. The inner member has a grooved profile on its exterior. The outer member has a grooved profile in its bore. A split latch ring is carried by the inner member. The ring has an inner profile that mates with the profile on the inner member. The ring has an outer profile that mates with the profile in the bore. The ring cannot move axially relative to the inner member while fully engaging the inner member profile. Similarly, the ring cannot move axially relative to the outer member while fully engaging the profile of the outer member. The inner member is released by a releasing device which provides an axial force to the ring independent of any force applied to the inner or outer members.

3 Claims, 2 Drawing Sheets

LATCH RING FOR CONNECTING TUBULAR MEMBERS

CROSS REFERENCE TO RELATED APPLICATION

This is a continuation-in-part of application Ser. No. 286,603, filed Dec. 16, 1988, U.S. Pat. No. 4,928,769 CASING HANGER RUNNING TOOL USING STRING WEIGHT, and a continuation-in-part of application Ser. No. 362,843, filed June 6, 1989, PACKOFF RUNNING TOOL WITH ROTATIONAL CAM.

BACKGROUND OF THE INVENTION

1. Field of the Invention

This invention relates in general to equipment for offshore wells, and in particular to a latching device that will remotely latch and unlatch an inner member within an outer member.

2. Description of the Prior Art

In wells, applications exist wherein an inner member must latch within the bore of an outer tubular member. The latching must be accomplished remotely. Also, there must be some means to remotely release the latch to remove the inner member from the outer member.

Various latches exist which will allow an inner member to insert and latch to an outer member. Generally, this will comprise a profile of grooves in the bore of the outer member. The inner member carries a split ring. The ring will have a profile on its exterior that mates with the profile in the bore of the outer member. The ring will have a grooved profile on its interior that mates with the profile formed on the exterior of the inner member.

In the prior art, these rings will spring or be urged outward into the profile in the bore of the outer member when the inner member reaches the proper position. Once latched, load on the inner member will be supported by the outer member.

While these devices are workable, the outer member will not support both upward and downward loads imposed on the inner member. Also, often some over travel of the inner member is required in order to cause the latch to engage the profile in the bore of the outer member.

SUMMARY OF THE INVENTION

In this invention, the bore of the outer member has a profile with at least one groove with upward and downward facing load shoulders. The exterior of the inner member also has a profile with at least one groove and upward and downward facing load shoulders. The ring has profiles on its inner and outer diameters. The inner profile of the ring matches the profile on the inner member.

The profile on the exterior of the ring matches the profile in the bore of the outer member. Consequently, when ring has moved fully into the profile of the outer member, it cannot move axially relative to the outer member. When the ring engages the outer member, load can be imposed in either an upward or downward direction on the inner member.

A release means will release the ring by causing it to move out of the bore profile independently of any movement on the inner member or outer member. In the preferred embodiment, this comprises a depending release section which extends downward and inward from the ring. A release nut will move up to contact the release section and push the ring axially upward relative to the inner and outer members. This causes the ring to contract and allows the inner member to be pulled from the outer member.

DETAILED DESCRIPTION OF THE INVENTION

Figure 1:
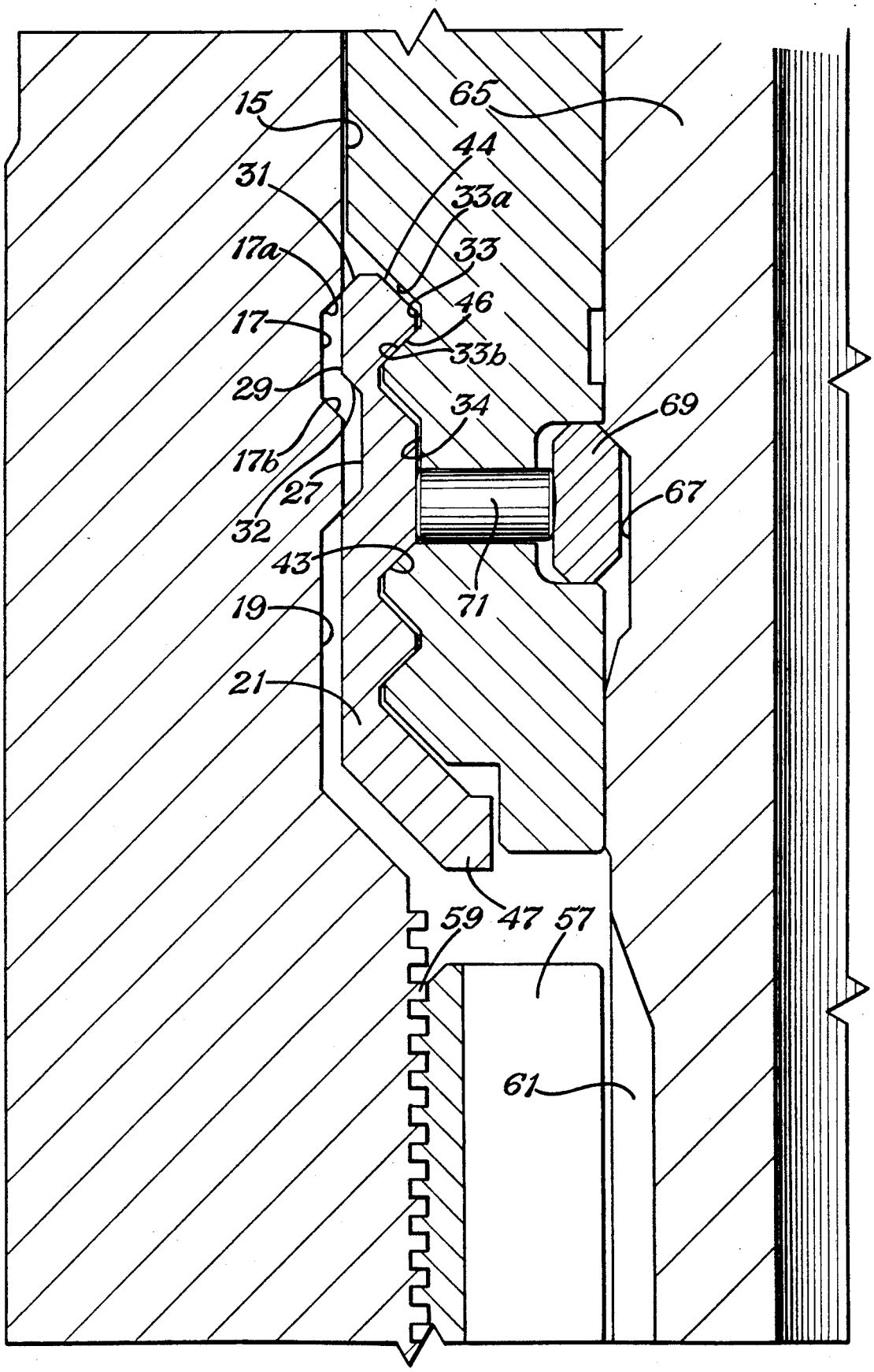
FIG. 1 is a partial vertical sectional view illustrating a device constructed in accordance with this invention, and showing the latch ring prior to engagement with the profile in the bore of the outer member.

Referring to FIG. 1, the outer member 11 in the embodiment shown is a housing of a running tool such as shown in pending application Ser. No. 362,843, filed June 6, 1989, PACKOFF RUNNING TOOL WITH ROTATIONAL CAM, all of which material is hereby incorporated by reference. The running tool, of which the outer member 11 is a part, is used to set a seal located between a casing hanger and a wellhead housing (not shown). The running tool also includes an inner member 13 which will be carried in the bore 15 of the outer member 11 for axial movement relative to the outer member 11.

A profile 19 will be formed in the bore 15. Profile 19 includes two axially spaced apart grooves 17 and a cylindrical section of bore 15 between them. Each groove 17 has a conical downward facing upper shoulder **17*a* and a conical upward facing lower shoulder 17*b*. The upper shoulders 17*a* of each groove 17 are parallel to each other and intersect the longitudinal axis of outer member 11 at a 45 degree angle. The lower shoulders 17*b* are parallel to each other and intersect the longitudinal axis of outer member 11 at 45 degrees, but offset 90 degrees from the upper shoulders 17*a*. The axial extent of the upper groove 17 from the upper shoulder 17*a* to the lower shoulder 17*b* is considerably less than the axial extent of the lower groove 17**.

A split ring 21 will be carried by the inner member 13 for engaging the grooves 17 of the outer member 11. Split ring 21 has a cut extending vertically through it to allow it to expand and contract radially. Additional partial cuts (not shown) in the ring 21 facilitate the expansion and contraction.

The split ring 21 has an outer profile 29 that has the same configuration as the profile 19 of the outer member 11. The outer profile 29 of the split ring 21 comprises an outer groove 27 which separates upper and lower sections dimensioned to fit closely in the grooves 17. The outer groove 27 is of the same axial and radial dimension as the section of bore 15 located between the grooves 17. The outer profile 29 has an upward facing load shoulder 31 for mating with each downward facing load shoulder **17*a* of the outer member profile 19. Each load shoulder 31 is parallel with each load shoulder 17*a*. The outer profile 29 has a downward facing load shoulder 32 for each upward facing load shoulder 17*b* of the outer member profile 19. Each load shoulder 32 is parallel with each load shoulder 17*b***.

Figure 2:
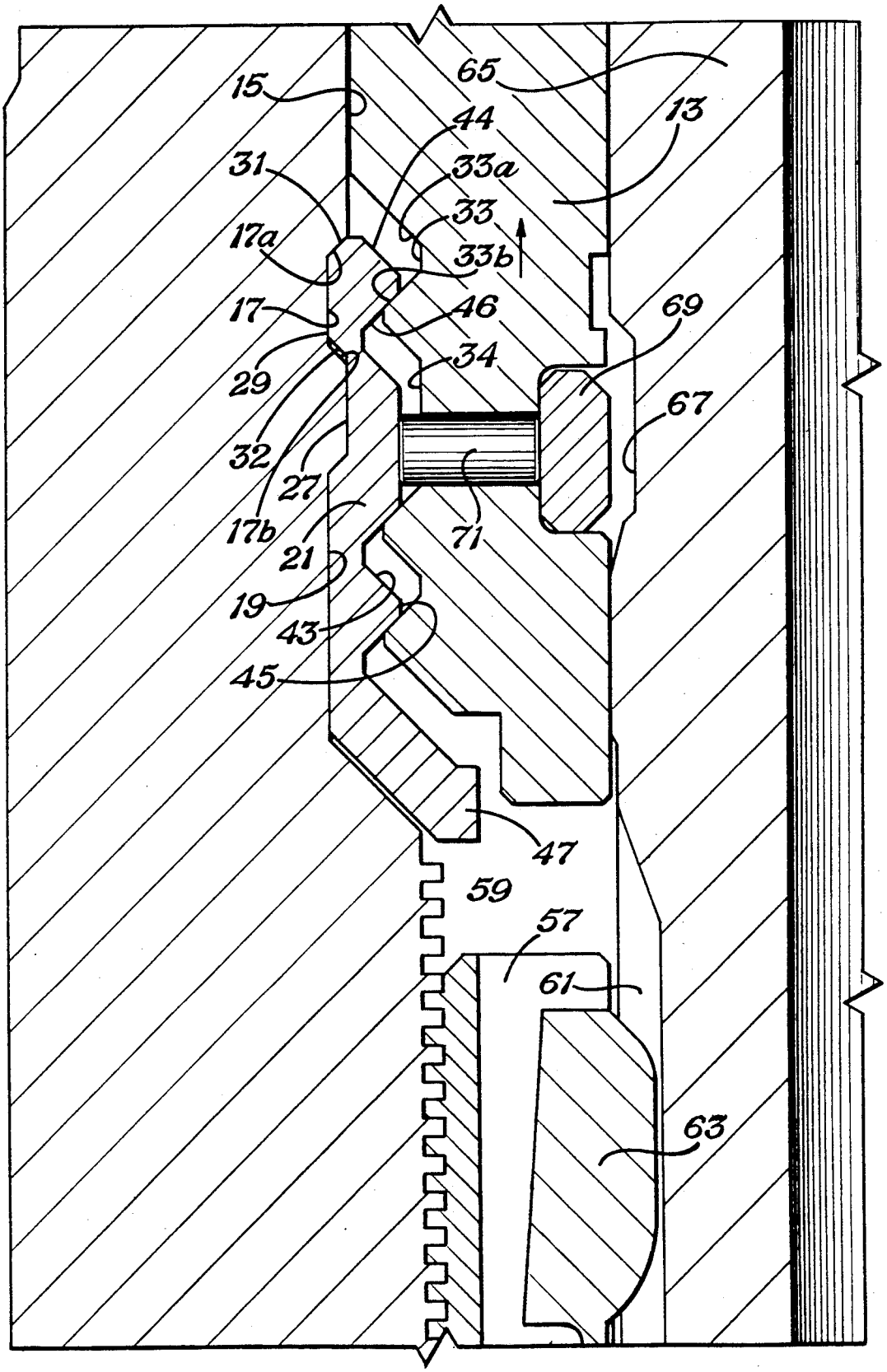
FIG. 2 is a vertical sectional view of the latching device of FIG. 1, and showing the latch ring engaging the profile in the bore of the outer member.

The axial distance between each opposed upward and downward facing load shoulder **17*a*, 17*b* is the same axial distance between adjacent upward and downward facing load shoulders 31, 32. When the ring 21 fully locates in the grooves 17, as shown in FIG. 2, the ring 21 cannot move in pure axial movement relative to the outer member 11 because of the engagement of the shoulders 31 with the shoulders 17***a* and the shoulders 32 with the shoulders 17*b*.

The inner member 13 has a profile 34 on its exterior that comprises three axially spaced apart circumferential grooves 33 and the cylindrical exterior of the inner member 13 between the grooves 33. Each groove 33 has a conical upper shoulder 33*a* that faces downward. Each groove 33 also has a lower shoulder 33*b* that faces upward. The shoulders 33*a* and 33*b* each intersect the longitudinal axis of the inner member 13 at 45 degree angles, but 90 degrees apart from each other. The axial dimensions of the upper and lower grooves 33 are the same, and substantially smaller than the middle groove 33. The inner member downward facing shoulders 33*a* are parallel with the outer member upward facing shoulders 17*b*. The inner member upward facing shoulders 33*b* are parallel with the outer member downward facing shoulders 17*a*. The radial depth of the inner member grooves 33 is about twice the radial depth of the outer member grooves 17.

The ring 21 has an inner profile 45 for engaging the profile 34 on the exterior of the inner member 13. The inner profile 45 of the ring 21 has the same configuration as the profile 34 on the inner member 13. This includes spaced apart grooves 43 which closely receive the sections of the inner member between the grooves 33. Inner profile 45 has an upward facing load shoulder 44 for each downward facing load shoulder 33*a* of the inner member profile 34. Inner profile 45 has a downward facing load shoulder 46 for each upward facing load shoulder 33*b* of inner member profile 34. Each load shoulder 44 is parallel with each load shoulder 33*a*. Each load shoulder 46 is parallel with each load shoulder 33*b*. When the ring 21 fully engages the grooves 33, it cannot move in pure axial movement relative to the inner member 13 because of the engagement of shoulders 44 with shoulders 33*a* and shoulders 46 with shoulders 33*b*.

A releasing section 47 extends radially inward from the lower end of ring 21. The releasing section 47 has a lower shoulder that is perpendicular to the longitudinal axis of the inner member 13 and lower than the lower end of the inner member 13. Releasing section 47 will extend inward from the profile 19 within the bore 15.

The means to release the ring 21 is a device that will cause the ring 21 to contract inward and which moves independent of any movement of the inner member 13 or outer member 11. In the preferred embodiment, the releasing device will apply an axially upward force on the split ring 21 independent of any forces on the inner and outer members 11, 13. The release means includes the release section 47 and a release nut 57. The release nut 57 is secured by threads 59 to the bore 15 of the outer housing 11 below the lower groove 17. When the release nut 57 is rotated upward, it will contact the lower end of the release section 47 to push the split ring 21 upward.

The means to rotate the releasing nut 57 includes a vertically extending slot 61 that is engaged by a finger 63 (FIG. 2) that is carried with the releasing nut 57. The finger 63 is biased inward to engage the slot 61. The slot 61 is formed on the exterior of a mandrel 65 that is part of the running tool. When rotated, mandrel 65 rotates the finger 63 and therefore the releasing nut 57.

Although not part of this invention, the running tool has a means for locking the mandrel 65 to the inner member 13 against axial movement at certain points of the operation. This includes a recess 67 formed on the exterior of mandrel 65. A split ring 69 will be biased inward to engage the recess 67. A link pin 71 engages the inner diameter of ring 21. When the link pin 71 moves outward, which occurs when the ring 21 engages the grooves 17 in bore 15, then the mandrel 65 can push the ring 69 outward. This allows the mandrel 65 to move downward relative to the inner member 13. This operation is explained in more detail in parent application Ser. No. 362,843, filed June 6, 1989, PACKOFF RUNNING TOOL WITH ROTATIONAL CAM.

In operation, prior to latching the inner member 13 within the outer member 11, the ring 21 will be contracted into the grooves 33. The exterior of ring 21 will slidingly engage the bore 15. The exterior of the ring 21 will be flush with the exterior of the inner member 13 when the ring 21 engages the grooves 33.

The inner member 13 will move downward relative to the outer member 11 until substantially at the point shown in FIG. 1. At this point, the bias in the ring 21 will cause it to move outward and downward at a 45 degree angle relative to the axis of the outer member 13 into the grooves 17. The 45 degree downward movement is a result of the parallel inclined shoulders 17*a* and 33*b*. The inner member 13 does not need to be moved downward and then pulled back up in order for engagement to occur.

When the ring 21 fully engages the grooves 17, it will appear as shown in FIG. 2. The ring 21 will have extended partly out of the grooves 33, but sufficient engagement still remains to apply an upward load, as indicated by the arrow. The upward load on the inner member 13 will be transmitted from the shoulders 33*b*, through the ring 21 and through the shoulder 17*a*. The ring 21 will not be able to move relative to the outer member 11 once it engages the grooves 17, unless it is forced to radially contract by the releasing nut 57. The upward load passing upward and outward through the ring 21 and the outward bias of ring 21 prevent the ring 21 from contracting.

If a downward load is imposed in the inner member 13 when it is in the position shown in FIG. 2, the inner member 13 will move downward slightly from the position shown in FIG. 2 to a lower position (not shown). The ring 21 and outer member 11 will remain stationary. Ring 21 will not contract during this transition movement because of its outward bias. When the inner member 13 reaches the lower position, the upper shoulders 33*a* will transmit load downward through the ring 21 and to the lower shoulders 17*b*. The ring 21 cannot move out of the outer member profile 19 in either upward of downward load unless it is forced to radially contract by a force independent of the load on the inner member 13.

To release the ring 21, the operator rotates the mandrel 65. The finger 63 causes the releasing nut 57 to rotate. The nut 57 will contact the releasing section 47 and push upward on the ring 21. The ring 21 will slide upward and inward relative to the outer member profile 19 and fully engage the inner member grooves 33. The ring 21 will disengage completely from the bore grooves 17. The inner member 13 may then be pulled upward, with the ring 21 in the contracted position.

The invention has significant advantages. The inner member latches positively to the outer member at the predetermined position. Further downward movement or over travel is not required. The latch will handle both upward and downward load with only a slight amount of slack movement of the inner member. The latch cannot be released by axial movement of either inner or outer member with respect to each other. The latch is released by applying a force to the latch independent of the inner and outer members.

While the invention has been shown in only one of its forms, it should be apparent to those skilled in the art that it is not so limited, but is susceptible to various changes without departing from the scope of the invention.

I claim:

1. A device for releasably locking an inner member within a bore of a tubular outer member, comprising in combination:

a grooved inner member profile formed on the exterior of the inner member, the inner member profile having at least one upward facing load shoulder and at least one downward facing load shoulder;

a grooved outer member profile formed in the bore of the outer member, the outer member profile having at least one upward facing load shoulder and at least one downward facing load shoulder;

a split ring carried by the inner member, the ring having a grooved inner profile on its interior for engaging the inner member profile, the ring being resiliently contractible into the inner member profile so as to be able to pass into the bore of the outer member;

the ring having a grooved outer profile on its exterior that mates with the outer member profile, the ring springing outward into the outer member profile when aligned with the outer member profile, the outer profile of the ring having at least one upward and at least one downward facing load shoulder, the upward and downward facing load shoulders of the outer profile being spaced apart substantially the same axial distance as the mating upward and downward facing load shoulders of the outer member profile so as to prevent substantially all pure axial movement of the ring relative to the outer member when the ring engages the outer member profile;

the inner member being axially movable, relative to the outer member and ring when the ring is engaging the outer member profile, from a lower position to an upper position, in the lower position, a downward force on the inner member transmitting from the downward facing load shoulder of the inner member profile through the ring to the upward facing load shoulder of the outer member profile to support the inner member in downward load, in the upper position, an upward force on the inner member transmitting from the upward facing load shoulder of the inner member profile through the ring to the downward facing load shoulder of the outer member profile to support the inner member in upward load; and means movable independently of the inner and outer members for causing the ring to contract from the profile of the outer member to release the inner member from the outer member.

2. A device for releasably locking an inner member within a bore of a tubular outer member, comprising in combination:

a grooved inner member profile formed on the exterior of the inner member, the inner member profile having at least one conical upward facing load shoulder and at least one conical downward facing load shoulder;

a grooved outer member profile formed in the bore of the outer member, the outer member profile having at least one conical upward facing load shoulder and at least one downward facing load shoulder, the upward facing load shoulder of the inner member profile being parallel with the downward facing load shoulder of the outer member profile;

a split ring carried by the inner member, the ring having a grooved inner profile on its interior that mates with and has substantially the same configuration as the inner member profile, the ring being resiliently contractible into the inner member profile so as to be able to pass into the bore of the outer member;

the ring having a grooved outer profile on its exterior that mates with and has substantially the same configuration as the outer member profile, the ring springing outward into the outer member profile when aligned with the outer member profile so as to prevent substantially all pure axial movement of the ring relative to the outer member when the ring engages the outer member profile;

the inner member being axially movable, relative to the outer member and the ring when the ring is engaging the outer member profile, from a lower position to an upper position, in the lower position, a downward force on the inner member transmitting from the downward facing load shoulder of the inner member profile through the ring to the upward facing load shoulder of the outer member profile to support the inner member in downward load, in the upper position, an upward force on the inner member transmitting from the upward facing load shoulder of the inner member profile through the ring to the downward facing load shoulder of the outer member profile to support the inner member in upward load: and means movable independently of the inner and outer members for causing the ring to contract from the profile of the outer member to release the inner member from the outer member.

3. A device for releasably locking an inner member within a bore of a tubular outer member, comprising in combination:

a grooved inner member profile formed on the exterior of the inner member, the inner member profile having at least one conical upward facing load shoulder and at least one conical downward facing load shoulder;

a grooved outer member profile formed in the bore of the outer member, the outer member profile having at least one conical upward facing load shoulder and at least one conical downward facing load shoulder, the upward facing load shoulder of the inner member profile being parallel with the downward facing load shoulder of the outer member profile;

a split ring carried by the inner member, the ring having a grooved inner profile on its interior that mates with and has substantially the same configuration as the inner member profile, the ring being resiliently contractible into the inner member profile so as to be able to pass into the bore of the outer member;

the ring having a grooved outer profile on its exterior that mates with and has substantially the same configuration as the outer member profile, the ring springing outward into the outer member profile when aligned with the outer member profile so as to prevent substantially all pure axial movement of the ring relative to the outer member when the ring engages the outer member profile;

the inner member being axially movable, relative to the outer member and the ring when the ring is engaging the outer member profile, from a lower position to an upper position, in the lower position, a downward force on the inner member transmitting from the downward facing load shoulder of the inner member profile through the ring to the upward facing load shoulder of the outer member profile to support the inner member in downward load, in the upper position, an upward force on the inner member transmitting from the upward facing load shoulder of the inner member profile through the ring to the downward facing load shoulder of the outer member profile to support the inner member in upward load;

a release section on the lower end of the ring, extending inward from the inner profile; and means axially movable relative to the inner and outer members for applying an upward axial force to the release section, causing the ring to contract from the profile of the outer member to release the inner member from the outer member.

* * * * *

UNITED STATES PATENT AND TRADEMARK OFFICE

CERTIFICATE OF CORRECTION

PATENT NO. : 5,020,593

DATED : June 4, 1991

INVENTOR(S) : Lionel J. Milberger

It is certified that error appears in the above-identified patent and that said Letters Patent is hereby corrected as shown below:

On the title page:

In the second line of "related U.S. application data, "492,876" should be changed to--4,928,769--.

Signed and Sealed this

Fifteenth Day of June, 1993

*Attest:*

Michael K. Kirk

MICHAEL K. KIRK

*Attesting Officer*

*Acting Commissioner of Patents and Trademarks*